United States Patent [19]

Hesener

[11] Patent Number: 4,706,397

[45] Date of Patent: Nov. 17, 1987

[54] PICTURE FRAME

[76] Inventor: Walter Hesener, 66, rue de la Prulay, 1217 Meyrin-Geneva, Switzerland

[21] Appl. No.: 793,104

[22] Filed: Oct. 30, 1985

[30] Foreign Application Priority Data

| | | | |
|---|---|---|---|
| Nov. 5, 1984 | [CH] | Switzerland | 5282/84 |
| Nov. 12, 1984 | [CH] | Switzerland | 5398/84 |
| Jan. 15, 1985 | [CH] | Switzerland | 162/85 |

[51] Int. Cl.[4] ..... A47G 1/06

[52] U.S. Cl. ..... 40/152; 40/152.1

[58] Field of Search ..... 40/152, 152.1, 158 R, 40/156

[56] References Cited

U.S. PATENT DOCUMENTS

| | | | |
|---|---|---|---|
| 224,973 | 2/1880 | Wallis | 40/152 |
| 739,019 | 9/1903 | McGinn | 40/152 |
| 2,432,515 | 12/1947 | De Sherbinin | 40/152 |
| 3,339,302 | 9/1967 | Mallory | 40/152 |
| 3,471,959 | 10/1969 | Seger | 40/152 |
| 3,673,724 | 7/1972 | Bell et al. | 40/152 |
| 3,722,122 | 3/1973 | Sesto | 40/152 |
| 3,952,435 | 4/1976 | Olsen | 40/152 |
| 4,017,989 | 4/1977 | Murray | 40/152 |
| 4,043,477 | 8/1977 | Deese | 40/152 |
| 4,432,152 | 2/1984 | Daenen | 40/152.1 |
| 4,532,727 | 8/1985 | Klose et al. | 40/152 |

*Primary Examiner*—Gene Mancene
*Assistant Examiner*—Cary E. Stone
*Attorney, Agent, or Firm*—Fleit, Jacobson, Cohn & Price

[57] ABSTRACT

Each picture frame cassette has a frame member with two crossing rectangular frames which surround a picture window. A back-plate is fitted at the rear of the frame member behind the picture window. The frame member and back-plate enclose a picture seating, the end regions of which are open at the rear for the fitting and engaging of photographs. The cassettes are secured together by tongues fitted in seatings in the back-plate and are engaged by projections with apertures in the seatings. Securing recesses and string are attached therein for hanging purposes.

21 Claims, 9 Drawing Figures

Figure 6:
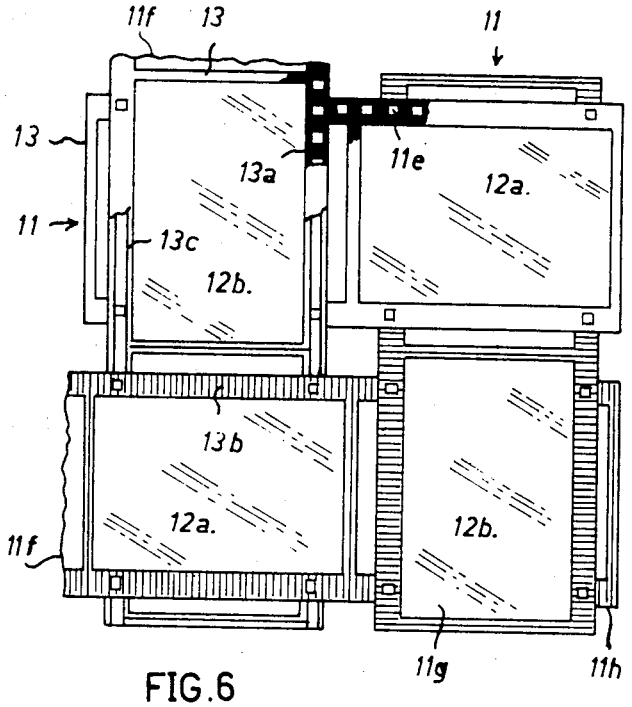

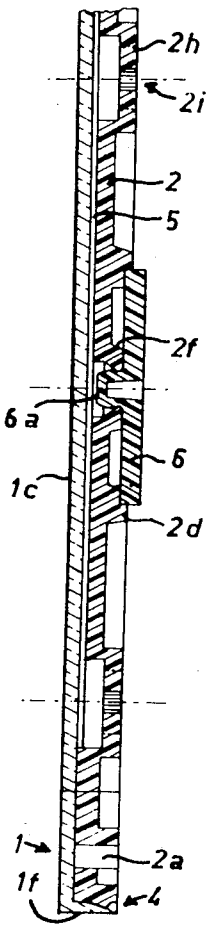
FIG. 4 (C-C)
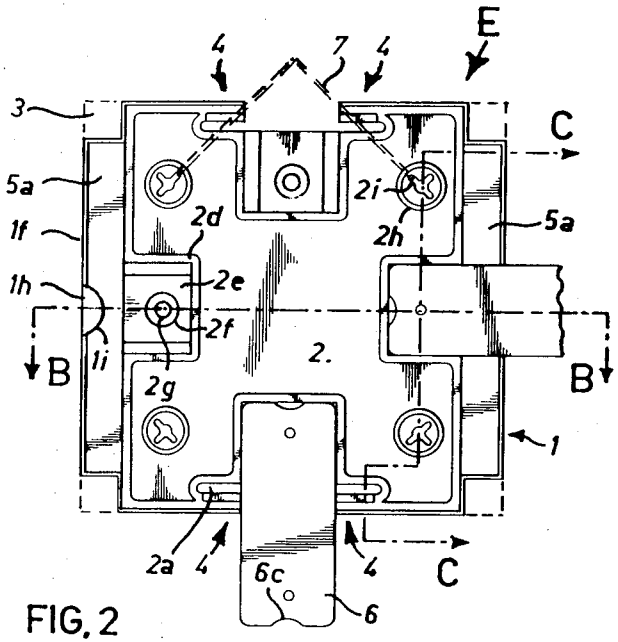
FIG. 2
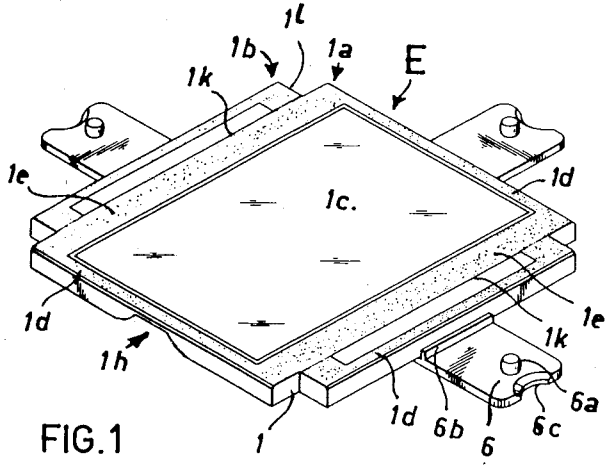
FIG. 1
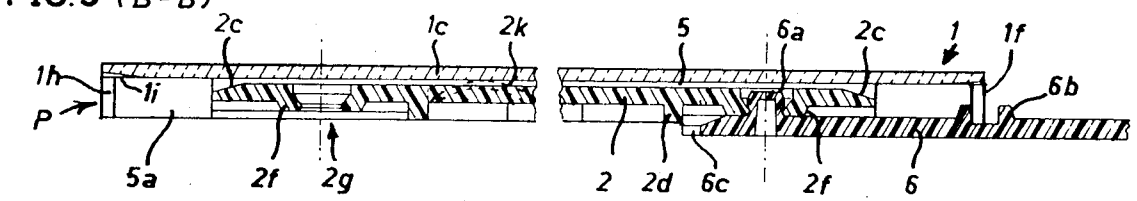
FIG. 3 (B-B)

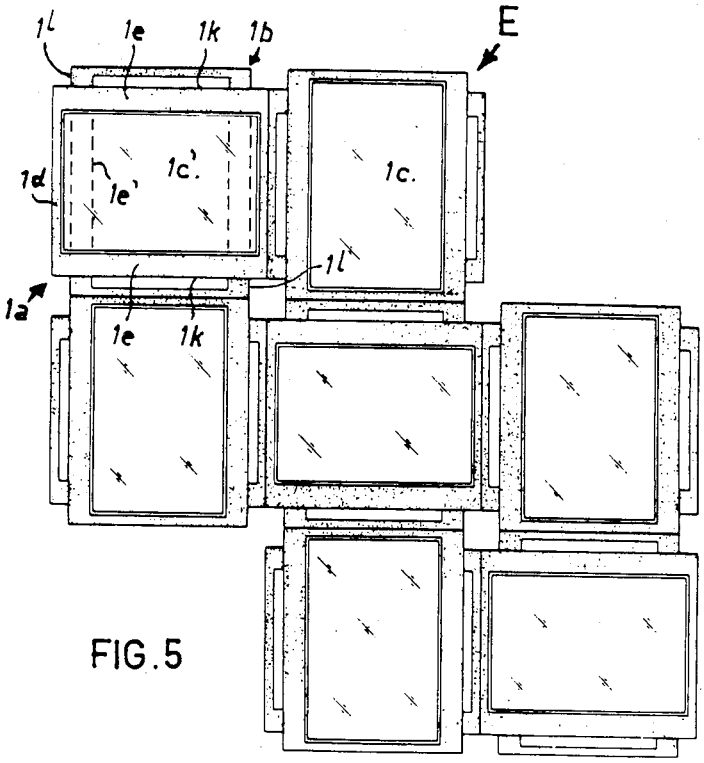
FIG.5
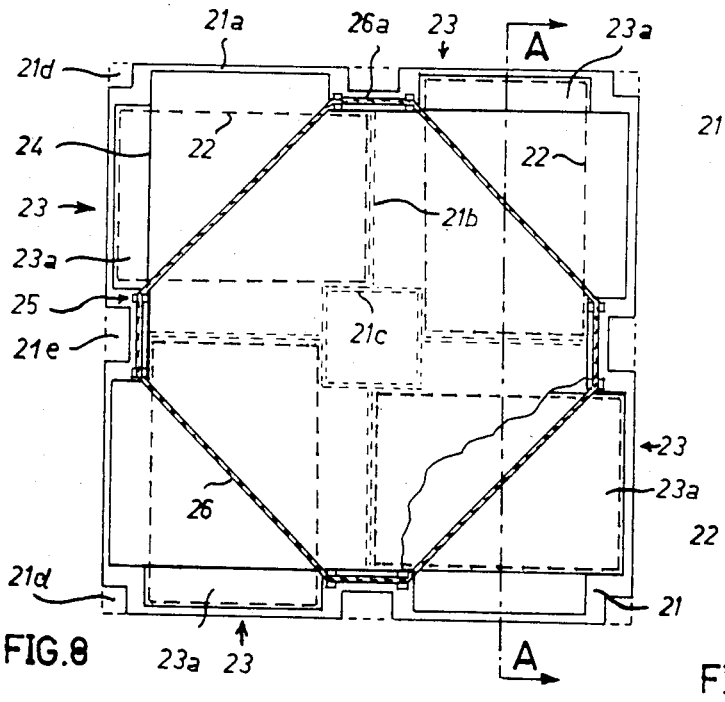
FIG.8
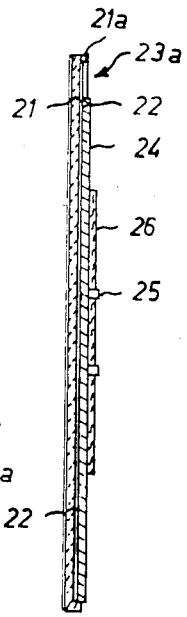
FIG.9 (A-A)

PICTURE FRAME

The invention concerns a picture frame which may be designed for any number of pictures, especially photographs, comprising a front frame member, enclosing at least one picture window, and a back-plate held against it to secure a picture which may be placed behind the picture window.

Every amateur photographer needs to be able to exhibit a few particularly nice photographs of one or another of his films as an agreeable wall decoration and to be able to replace them easily by the next good photographic result.

Existing interchangeable frames do not meet this need, for either manipulation and/or aesthetic reasons. These frames, which may or may not have borders or masks, rarely encourage anyone to change a picture since the procedure is too cumbersome. Moreover, it is impossible with these interchangeable frames to set up a modern arrangement of several photographs of standard size.

A known picture frame system with cassette-type components which may be combined together has the same drawbacks.

It is the aim of the invention to provide a picture frame which may be designed for holding any number of pictures and which is particularly suitable for the arrangement of horizontally or vertically-taken photographs of a standard size, e.g., 9×13 cm, and can also accomodate standard-sized square pictures, e.g., 9×9 cm. The design is intended to make it as simple as possible to interchange the pictures.

According to the invention, the frame member of the picture holder has, in plan view, two rectangular frames identical in area and shape, and crossing each other symmetrically in the manner of a Greek cross, with the picture window bordered at least on two parallel sides by a longitudinal element of one rectangular frame extending beyond an end region of the other rectangular frame.

This design extends the rectangular shape of the picture window into a square basic or cover shape of the picture unit while optically concealing the square shape. Squares may, however, be put together as desired by laying out the picture window transversely or longitudinally for each picture unit. The picture frame thereby appears, however, by no means as a group of squares but as an undulating pattern of rectangular frames.

Further advantages of the cruciform for the arrangement of the backplate and the picture backing, enhanced front panel stability, etc., will become clear from the description with reference to the drawings.

Another embodiment of the invention concerns a picture frame of the type described in the preamble in the form of a combination system, the combination unit of which consists of a single-picture cassette (E) designed for interconnection, having a frame member (1) with a picture window (1*c*), on which a seating for a picture to be placed behind the picture window and a seating for a back-plate are formed at the rear, the frame member having a square basic or cover area is provided with a symmetrically-arranged oblong picture window, the back-plate fitted in the frame member of the rear crosses the picture window and is so dimensioned that at least one of two end regions of the picture seating is open at the rear, and the back-plate is, in the region of the picture window, at a slight distance from the back of the frame member to provide the seating for the picture.

Figure 7:
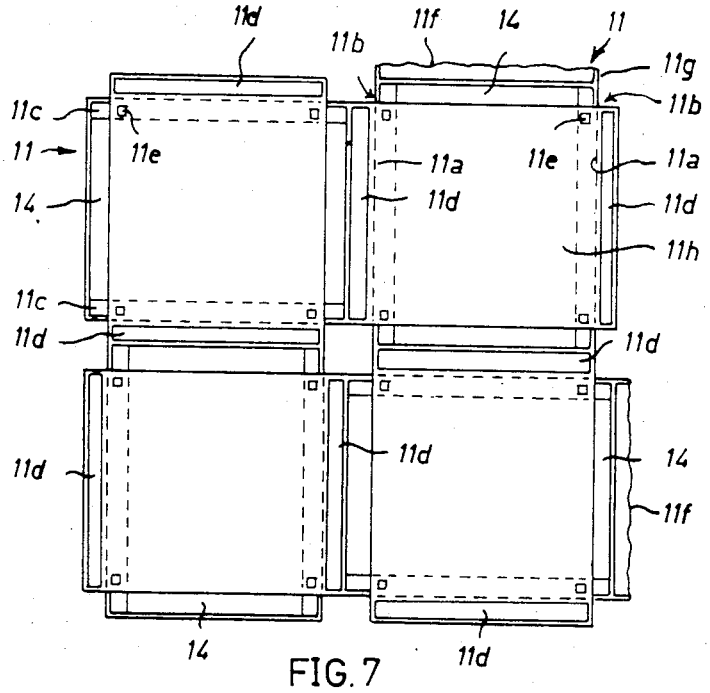

Embodiments of the invention are illustrated in the drawings, which show:

FIGS. 1 to 5: a picture frame system consisting of single-picture cassettes;

FIGS. 6 and 7: a picture frame consisting of interlocking rails, and

FIGS. 8 and 9: a picture frame with a one-piece frame member designed for several picture windows.

The picture frame of FIGS. 1 to 5 shows a single-picture cassette E. According to FIG. 5, seven such cassettes are combined together. Each cassette E consists of the frame member 1 designed as a front-plate and the back-plate 2. At the front, front-plate 1 has two symmetrically crossing rectangular frames 1*a*, 1*b*, giving a cruciform plan with a square cover shape 3. One rectangular frame 1*b* is interrupted by the other 1*a*, providing the rectangular picture window 1*c* in the latter. The cross-elements 1*d* of the rectangular frames 1*a*, 1*b* are narrower than its longitudinal elements 1*e* in order to reduce the length of the cover square 3 and thus the size of cassette E for a given window size to the minimum.

A seating for back-plate 2 is formed by the rear circumferential rim 1*f* in front-plate 1. Back-plate 2 is rectangular in plan and, completing the interrupted frame 1*b*, extends transversely to the longitudinal direction of the picture window 1*c*. It engages with circumferential rim 1*f* of front-plate 1 at the points indicated by 4. Engagement and disengagement are facilitated by slots 2*a* in the back-plate. Transversely, back-plate 2 has the flat channel of about the width of the picture window which, together with front-plate 1, forms the seating 5 for a photograph to be inserted. As the end regions 5*a* of picture seating 5 are open at the rear, i.e., are not covered by back-plate 2, the picture (photograph) can be slid into seating 5 by one transverse side (in the direction of arrow P) and removed in the same way. The gap 1*h* in the rim 1*f* and the curved recess 1*i* in the front-plate make it possible to grip the pictures to be removed with the thumb-nail, for instance. The sloping surfaces 2*c* of the back-plate also facilitate the removal of the picture.

The interconnection of the single-picture cassettes E is effected by means of connecting tongues 6. To this end, a seating 2*e*, surrounded on three sides by strap 2*d*, is formed at the rear of back-plate 2 in the middle of each circumferential side. Inside the seating there is a convex bulge 2*f* with an engagement aperture 2*g*, which acts like a press-stud with the projections 6*a* on connection tongues 6. As the tongue seating 2*e* is not locally limited to a narrow area of the back-plate rim, but covers a relatively large area of that plate, the connection is extremely solid. The connecting tongues 6 grip behind corresponding regions of the circumferential rim 1*f* of front-plate 1 with the two straps 6*b* forming a channel. Tongue recesses 6*c* provide a point for the insertion of a screwdriver or knife for the purposes of disengagement.

At the rear, in the corner areas of back-plate 2, are other convex bulges 2*h* with slot arrangements 2*i*. These are for holding string-like hanging members 7 with ends thickened into the form of a button. Each slot arrangement 2*i* consists of three slots facing one another in T array with a central region widened into a key-hole shape, with each central slot oriented diagonally towards the appropriate corner of the cover square 3. In order to see the advantages of this slot arrangement, it must be understood that each cassette may be fitted with its picture window directed longitudinally or transversely and that the gravity line may run along the middle of the cassette (FIG. 5) or along the dividing line between two neighboring cassettes (e.g., with four cassettes together forming a square). In the latter case, string 7 is not secured as in FIG. 2, but extends from one slot arrangement of one cassette to the neighboring one of the next cassette. All these requirements are taken into account in the hanging device.

Rectangular frames 1*a*, 1*b* of front-plate 1 of transparent thermoplastic material may be applied thereto by screen printing or heat embossing, for example.

There is a variety of advantages to this picture frame. The square cover shape of the cassettes E fitted with rectangular windows 1*c* permit cassettes to be easily arranged in an infinite number of combinations, with the direction of the windows (longitudinally or transversely) selectable at will. In a cassette with a rectangular picture window 1*c*, only the end region 1*l* projecting beyond the longitudinal sides 1*k* of the other rectangular frame 1*a* of the interrupted rectangular frame 1*b* remains. By fitting the interrupted longitudinal element regions 1*e'* of the appropriate rectangular frame 1*b*, every rectangular picture window 1*c* may, however, be converted into a square window 1*c'*, which fits just as well into the entire combination. It is advantageous to give the longitudinal elements 1*e'* subsequently, where needed, the form of a suitably printed transparent film which is simply pushed into the picture seating 5. This gives the user a wider choice of combinations, in that he can set out or combine a picture frame designed for the standard photograph format of 9×13 cm as desired for longitudinal and/or transverse 9×13 photographs and/or for 9×9 photographs. Although the edges of cassettes E are in direct contact, picture windows 1*c*, 1*c'* are separated at least on two sides. Thus within and despite the grouped arrangement, this provides an individual presentation of each picture window 1*c*, 1*c'*, i.e., of each picture. Nevertheless, all picture windows 1*c*, 1*c'* are decently interconnected by the necessarily produced combination resembling a simple weave. The simple hanging device in the form of a slot arrangement 2*i* takes account of every possible combination of pictures. It is even possible to change pictures in the rectangular format with the frame hanging on the wall. The entire structure requires a minimum of parts, materials and fitting.

The broad longitudinal elements 1*e* of the rectangular frames 1*a*, 1*b* are eminently suitable for the widest variety of graphic design.

As shown by the cross-hatching in FIG. 3, it is possible to shape back-plate 2 with at least one spring-like position 2*k* pressing lightly against front-plate 1. This allows circumferential edge 1f to be completely interrupted in the region of the end of a picture window to make changing photographs even easier. Moreover, spring 2*k* would center a square or grossly undersized photograph.

The cruciform is also helpful in stabilizing where the frame member takes the form of a thin front-plate 1.

A flexible film pushed behind the pictures fitted in the frames makes it possible for said pictures to be protectively covered within the end regions 5*a* of picture seatings 5 which are open at the rear.

The rectangular frames 1*a*, 1*b* surrounding picture windows 1*c*, 1*c'* and consisting in the embodiment of a coating on front-plate 1 can, of course, also take the conventional form of an independent frame in which transparent panes are fitted from behind to cover picture windows 1*c*, 1*c'* (although these may, of course, be omitted). The embodiments concerning the construction of said rectangular frames 1*a*, 1*b* merely represent particularly inexpensive devices which are nevertheless highly contemporarily styled.

In an alternative construction, the picture frame of FIGS. 6 and 7 consists of four flat rails 11. Two of the rails are shown as partial lengths (broken off at point 11*f*) in order to illustrate the extensibility of the system. The rails cross one another in the manner of a simple weave. They mutually interlace within their crossing areas, to which end they are fitted with transverse channels 11*a*, 11*b*. The upper longitudinal rail regions 11*g* in the crossing areas have the longitudinally and transversely oriented picture windows 12*a*, 12*b* which, after the manner of the first embodiment, are enclosed by mutually crossing rectangular frames 13. It may be seen from FIG. 6 that the longitudinal frame elements may be properly graphically designed by means, for instance, of rows of holes 13*a*, transverse strips 13*b*, longitudinal strips 13*c* or the like.

In order to form the picture seatings 14, the transverse channel 11*b* of the longitudinal rail regions 11*g* are recessed beneath their picture windows 12*a*, 12*b* from the opposite seating plane 11*c* and elongated in longitudinal direction along the corresponding rails. Recesses 11*d* of the longitudinal rail areas 11*h* at the back of the crossing areas are to provide approximately equal wall thicknesses.

Holes 11*e* for self-securing pins (not shown) are provided in the corners of the crossing areas so that rails 11 may be secured together. In addition, they may, on the back of the frame, be used to anchor a hanging cord or the like. It is, of course, possible to shape rails 11 for direct mutual engagement in the manner of the first embodiment.

If all rails 11 are made only in the length of one picture window 12*a*, 12*b*, single-picture cassettes are formed which are similar to the first embodiment (with as many possible combinations). Here, the rear rails of the cassette would have to be fitted with fixing means for connecting tongues (as shown in FIGS. 1 to 4) for an interconnection of the cassettes.

If the user is prepared to forego facilities for combination, a picture frame of the invention laid out for several photographs may be fitted with a one-piece front-plate. Such an embodiment is illustrated diagrammatically with reference to FIGS. 8 and 9. Front-plate 21 is graphically designed in accordance with FIG. 6 at the front and has four picture windows. At the rear, front-plate 21 has circumferential rim 21*a*, separator strips 21*b* and central strip 21*c* forming a square. Seatings for photographs 22, shown cross-hatched, lie in the direction of the arrows 23 which also indicate the direction in which the photographs are pushed in. Back-plate 24 is also in one piece and leave the outer end regions 23*a* the seatings free so that photographs 22 may be pushed in and pulled out from the side.

Clamping projections 25 are formed at the rear on circumferential rim 21*a*. An elastic, self-clamping, stretched cord 26 is held between them at the rear of back-plate 24, and cord region 26*a* is used for hanging the frame.

In the embodiments of FIGS. 1 to 6 and 8 and 9 the outer cover shape may be used for the cut of the front-plate and the corner regions (3*i*, 21*d*, 21*e*) left transparent.

Square pictures (photographs) may, for instance, be rendered easy to put into position and change by sticking them with a piece of double-sided adhesive tape to a thin substrate of suitable rectangular format.

In the embodiments the picture windows 1*c*, 1*c'*; 12*a*, 12*b* are surrounded by straight lines (inner lines) of the rectangular frames 1*a*; 13. These lines may be curved or wavelike in view of a more romantic design of the picture frame.

I claim:

1. A picture frame comprising a front frame member for enclosing at least one picture window, a back-plate secured against said front frame member to hold a picture to be placed behind the window, said front frame member including two rectangular frames identical in area and shape, and crossing each other symmetrically in the form of a cross, with the picture window bordered on at least two parallel sides by a longitudinal element of one of said two rectangular frames extending beyond an end region of the other of said two rectangular frames, and the longitudinal elements of said one rectangular frame being wider than its transverse elements which interconnect the longitudinal elements.

2. A picture frame as claimed in claim 1, wherein one of said two rectangular frames is interrupted by the other.

3. A picture frame as claimed in claim 1, wherein said front frame member is in the form of a flat front-plate recessed at its rear to seat at least one picture and said back-plate and arranged at its front to form said two rectangular frames.

4. A picture frame as claimed in claim 3 wherein said back-plate carried at the rear of said front frame member crosses the picture window and at least one of the two end regions of a picture seating is open at the rear, and said back-plate is located at a distance from the rear of said front frame member within the area of the picture window forming the picture seating.

5. A picture frame as claimed in claim 4, wherein said back-plate is provided with securing means of connecting tongues for interconnection of neighboring picture frames and a seating for the connecting tongues surrounded by a strap and open towards the circumference of said back-plate is formed at the rear of said back-plate in the middle of each circumferential side, and a convex bulge rises from each seating on the rear of said back-plate provided with an engagement aperture for the tongues which are fitted with button-shaped projections.

6. A picture frame as claimed in claim 4, wherein the rear of said back-plate is shaped in its four corner regions into a convex bulge provided with a slot-like recess designed for securing a string-like hanging member having button-like thickened ends.

7. A picture frame as claimed in claim 4, wherein a rear circumferential rim of said front frame member has an interruption on the side of an end region of the picture seating which is open to the rear, engaging with a lower section of said front frame member.

8. A picture frame as claimed in claim 1, wherein said two rectangular frames include flat rails of at least the length of the picture window which interengage in a crossed manner by means of shaped transverse channels, where one transverse channel of an upper rail region at each crossing point is elongated to form a picture seating.

9. A picture frame as claimed in claim 1, wherein a series of the picture frames are interconnected having an oblong window.

10. A picture frame comprising a front frame member for enclosing at least one picture window, a back-plate secured against said front frame member to hold a picture to be placed behind the window, said front frame member including two rectangular frames identical in area and shape, and crossing each other symmetrically in the form of a cross, with the picture window bordered on at least two parallel sides by a longitudinal element of one of said two rectangular frames extending beyond an end region of the other of said two rectangular frames, said front frame member being in the form of a flat front-plate recessed at its rear to seat at least one picture and said back-plate and arranged at its front to form said two rectangular frames, and said back-plate carried at the rear of said front frame member crosses the picture window and at least one of the two end regions of a picture seating is open at the rear, and said back-plate is located at a distance from the rear of said front frame member within the area of the picture window forming the picture seating.

11. A picture frame as claimed in claim 10, wherein one of said two rectangular frames is interrupted by the other.

12. A picture frame as claimed in claim 10, wherein the longitudinal elements of said one rectangular frame being wider than its transverse elements which interconnect the longitudinal elements.

13. A picture frame as claimed in claim 10, wherein said back-plate is provided with securing means of connecting tongues for interconnection of neighboring picture frames and a seating for the connecting tongues surrounded by a strap and open towards the circumference of said back-plate is formed at the rear of said back-plate in the middle of each circumferential side, and a convex bulge rises from each seating on the rear of said back-plate provided with an engagement aperture for the tongues which are fitted with button-shaped projections.

14. A picture frame as claimed in claim 10, wherein the rear of said back-plate is shaped in its four corner regions into a convex bulge provided with a slot-like recess designed for securing a string-like hanging member having button-like thickened ends.

15. A picture frame as claimed in claim 10, wherein a rear circumferential rim of said front frame member has an interruption on the side of an end region of the picture seating which is open to the rear, engaging with a lower section of said front frame member.

16. A picture frame as claimed in claim 10, wherein said two rectangular frames include flat rails of at least the length of the picture window which interengage in a crossed manner by means of shaped transverse channels, where one transverse channel of an upper rail region at each crossing point is elongated to form a picture seating.

17. A picture frame as claimed in claim 10, wherein a series of the picture frames are interconnected having an oblong window.

18. A picture frame comprising a front frame member for enclosing at least one picture window, a back-plate secured against said front frame member to hold a picture to be placed behind the window, said front frame member including two rectangular frames identical in area and shape, and crossing each other symmetrically in the form of a cross, with the picture window bordered on at least two parallel sides by a longitudinal element of one of said two rectangular frames extending beyond an end region of the other of said two rectangular frames, and said two rectangular frames include flat rails of at least the length of the picture window which interengage in a crossed manner by means of shaped transverse channels, where one transverse channel of an upper rail region at each crossing point is elongated to form a picture seating.

19. A picture frame comprising a front frame member for enclosing at least one picture window, a back-plate secured against said front frame member to hold a picture to be placed behind the window, said front frame member including two rectangular frames identical in area and shape, and crossing each other symmetrically in the form of a cross, with the picture window bordered on at least two parallel sides by a longitudinal element of one of said two rectangular frames extending beyond an end region of the other of said two rectangular frames, and a plurality of the picture frames are interconnectable by a seating in said front frame member for said back-plate and said back-plate crosses said picture window and includes two end regions, one of said two end regions being open for receipt of a picture, and said back-plate being spaced from said front frame member in a region adjacent to said picture window to form a picture seating and wherein said picture window is an oblong window.

20. A picture frame system for any number of pictures, said picture frame system comprising a front member enclosing, at least, one picture window, and a back-plate secured against the front member to hold a picture to be placed behind the window, said front member surrounding said picture window having an outermost periphery in the shape of a cross in which the picture window is symmetrically arranged, said front member having the appearance of two rectangular members crossing each other, one of said two rectangular members being symmetrically interrupted by the other rectangular member and said picture window being arranged in the other rectangular member.

21. A picture frame system comprising:

a plurality of picture frames, each picture frame having a front plate including at least one picture window and shaped in the form of a cross and having the appearance of two rectangular members superimposed one on top of the other in the same plane, one of said two rectangular members surrounding said at least one picture window, a back-plate secured to said front plate to hold a picture located in said picture window, and means for interlocking said plurality of picture frames in said same plane.

* * * * *